US005440328A

United States Patent [19]

Nardone et al.

[11] Patent Number: 5,440,328

[45] Date of Patent: Aug. 8, 1995

[54] SINGLE-PASS MULTI-COLOR THERMAL PRINTER

[75] Inventors: Edward A. Nardone; Paul S. Follett, both of Wakefield; Harry D. Schofield, Narragansett; Paul R. Caron, Tiverton; Chris S. Rothwell, North Kingstown, all of R.I.

[73] Assignee: Atlantek, Inc., Wakefield, R.I.

[21] Appl. No.: 956,791

[22] Filed: Oct. 5, 1992

[51] Int. Cl.[6] ..... B41J 2/325

[52] U.S. Cl. ..... 347/173

[58] Field of Search ..... 346/76 PH, 150, 174; 400/120; 358/300

[56] References Cited

U.S. PATENT DOCUMENTS 4,540,992 9/1985 Moteki et al. ..... 346/76 PH

*Primary Examiner*—Huan H. Tran

*Attorney, Agent, or Firm*—Salter & Michaelson

[57] ABSTRACT

A seven color, single-pass thermal print engine includes three platen rollers equally spaced over a 180 degree arc, an uninterrupted length of receptor media which is received around the platens, three thermal printheads which make tangential contact with a respective platen, and a pair of output drive rollers for pulling the media around the platen rollers. The print engine further includes a media tensioning system consisting of a media tray, an "S" shaped media guide with an idler roll mounted inside the curve of the "S", a tensioning arm for applying tangential pressure to the receptor media and a pair of input pinch rollers. Color transfer ribbons surround each printhead and are contained in re-loadable cassettes. The platens, pinch rollers and tensioning assembly are mounted on a slide assembly so that the platen rollers, the pinch rollers and the tensioning system can be slidably withdrawn from the print engine for receptor media loading and ribbon cassette replacement.

11 Claims, 11 Drawing Sheets

SINGLE-PASS MULTI-COLOR THERMAL PRINTER

BACKGROUND OF THE INVENTION

The instant invention relates to color printing and more particularly relates to a single-pass multi-color thermal print engine.

Single-pass, multi-color electrostatic printers have heretofore been known in the art. In this regard, the U.S. Pat. Nos. 4,734,788 to Emmett et al; 4,804,979 to Kamas et al; and 5,006,868 to Kinoshita represent the closest prior art to the subject invention of which the applicant is aware.

The patent to Emmett et al discloses a single pass electrostatic color printer which has a straight paper path. The printer includes a continuous feed roll of paper which passes through a plurality of sequentially spaced electrostatic print stations. The paper is pulled through the printer by a drive roller located adjacent to the paper outlet. A pinch roller is associated with each print station wherein the pinch roller biases the paper against it's respective print station. Registration marks are printed along the lateral edges of the paper. The registration marks are read by optical sensors positioned at each print station. Using the data signals from the sensors, the printer continuously recalculates the correct printing position on the paper thus allowing the printer to compensate for shifting and stretching of the paper caused by the previous pinch roller.

The patent to Kamas et al discloses a single-pass multi-color printer/plotter incorporating four electrostatic print stations. The print stations are sequentially spaced along an elongated transport path, and each print station includes a transport roller system that allows the print media to traverse the print station with controlled force exerted on the media. The printer further includes a print registration system wherein each print station monitors registration marks to detect stretching or other deformations of the print media.

The patent to Kinoshita discloses a process for single-pass multi-color electrophotographic printing comprising the steps of forming first and second electrically charged oppositely polarized, latent images on a dielectric-covered photoconductive printing element. The printing process utilizes a Katsuragawa type, three layer photoconductive drum. During a single rotation of the drum two latent images are formed on the drum and thereafter first and second toners, oppositely charged and differently colored are applied to the first and second latent images, forming first and second toned images having different colors and different polarities. The toned images are then similarly charged and transferred to a print medium.

SUMMARY OF THE INVENTION

The instant invention provides a single-pass multi-color thermal print engine.

Briefly, the print engine comprises a media transport system and three thermal printhead assemblies. Each of the printhead assemblies includes a respective re-loadable ribbon cassette which is loaded with a color transfer ribbon. The printer is preferably supported in sliding rack enclosure to accommodate unit servicing and receptor media loading.

The media transport system comprises a media tray, a tensioning arm, a media guide having an "S" shaped guide portion, an idler roll mounted inside one of the curves of the "S"-shaped guide portion, a pair of input pinch rollers, three centrally located platen rollers which are equally spaced over an 180 degree arc, and a pair of output drive rollers. The media transport system is mounted on a slide assembly so that the media transport system is slidably movable between a printing position wherein the platen rollers are positioned beneath the printhead assemblies for printing and a withdrawn position wherein the platen rollers are withdrawn from beneath the printhead assemblies for receptor loading and ribbon cassette replacement. The media tray, tensioning arm and media guide function together as a media tensioning system to create "media back tension" which helps insure proper media tracking throughout the transport system. The use of the three equidistant platen rollers mounted around a 180 degree arc provides an arcuate media path through the printer allowing the three thermal printhead assemblies to be positioned in close proximity thereby minimizing the distance between them. The arcuate media path, together with the media back tensioning system stiffens the receptor media to insure a stable media path and good media position control within the printer.

An integer relationship exists between the circumference of the output drive rollers and the distance between each printhead dot line. The integer relationship establishes a periodicity correction means which compensates for radial or circumferential deviations in the drive rollers.

Each of the thermal printhead assemblies comprises a cantilever beam, a mounting assembly and a thermal printhead having a thermal print dot line. Each of the printhead assemblies corresponds to a respective platen roller wherein the printheads thereof make tangential contact with the receptor media received therearound. The mounting assemblies allow the printheads to be adjusted angularly about the center of their dot line, as well as permitting front-to-back and side-to-side dot line movement. The mounting assemblies also allow the printheads to spherically pivot thereby equalizing the tangential pressure along their dot lines when the printheads are biased against their respective platen rollers.

The mounting assemblies are pivotally connected to the cantilever beams by means of pivot shafts so that the mounting assemblies are pivotable towards and away from the platen rollers when the shafts are rotated. In this regard, the mounting assemblies are pivotable between an "up" position wherein the printheads are disengaged from the platen rollers and a "down" position wherein the printheads are in biased engagement with the platen rollers.

Movement of the printheads between the "up" position and the "down" position is accomplished through individual printhead pivot assemblies. Each pivot assembly corresponds to a respective printhead assembly. The pivot shaft of each printhead assembly is connected to its own pivot assembly and all three pivot assemblies are driven by a common stepping motor wherein all three printheads are raised or lowered simultaneously.

The re-loadable ribbon cassettes comprise a cassette body, a ribbon supply roll, and a ribbon take-up roll. The ribbon cassettes are loaded with one of three primary color ribbons which are used in conventional subtractive color printing. The cassette bodies include a female dovetail configuration and the cantilever beams include a corresponding male dovetail configuration for mounting of the ribbon cassettes thereon. The supply and take-up rolls of each ribbon cassette are coupled to individual ribbon drive sub-assemblies.

The ribbon drive sub-assemblies each include a ribbon take-up shaft and a ribbon pay-out shaft and in this regard, the ribbon rolls engage and disengage with the pay-out shaft and the take-up shaft when the ribbon cassettes are mounted on and removed from the cantilever beams. A common stepping motor drives all three ribbon take-up shafts simultaneously. Each of the pay-out shafts includes a frictional slip clutch which ensures ribbon back tension and thus keeps the ribbons free of wrinkles. Each of the take-up shafts also includes a frictional slip clutch so that the ribbon is not pulled from beneath the printhead during the printing process.

Accordingly, it is an object of the instant invention to provide a single-pass multi-color thermal printer which is compact in size.

It is another object of the instant invention to provide a single-pass multi-color thermal printer having a media transport system which is mounted on a slide assembly so that the media transport system is slidably movable between a printing position wherein the platen rollers are positioned beneath the printhead assemblies for printing and a withdrawn position Wherein the platen rollers are withdrawn from beneath the printhead assemblies for receptor loading and ribbon cassette replacement.

It is yet another object to provide a single-pass multi-color thermal printer which has a substantially arcuate media path.

It is still another object to provide a single-pass multi-color thermal printer wherein the platen rollers are equally spaced over an 180 degree arc.

It is yet still another object to provide a media tensioning system for applying tension to the receptor media.

It is even another object to provide a single-pass multi-color thermal printer in which an integer relationship exists between the circumference of the output drive rollers and the distance between each printhead dot line.

It is a further object to provide a single-pass multi-color thermal printer in which the color transfer ribbons are mounted in re-loadable cassettes.

It is still another object to provide mounting assembly for a thermal printhead which allows the printhead to be adjusted angularly about the center of it's dot line, as well as permitting side-to-side dot line movement.

It is yet another object to provide a mounting assembly for a thermal printhead which also allows the printhead to spherically pivot thereby equalizing the tangential pressure along it's dot line when the printhead is biased against it's respective platen roller.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
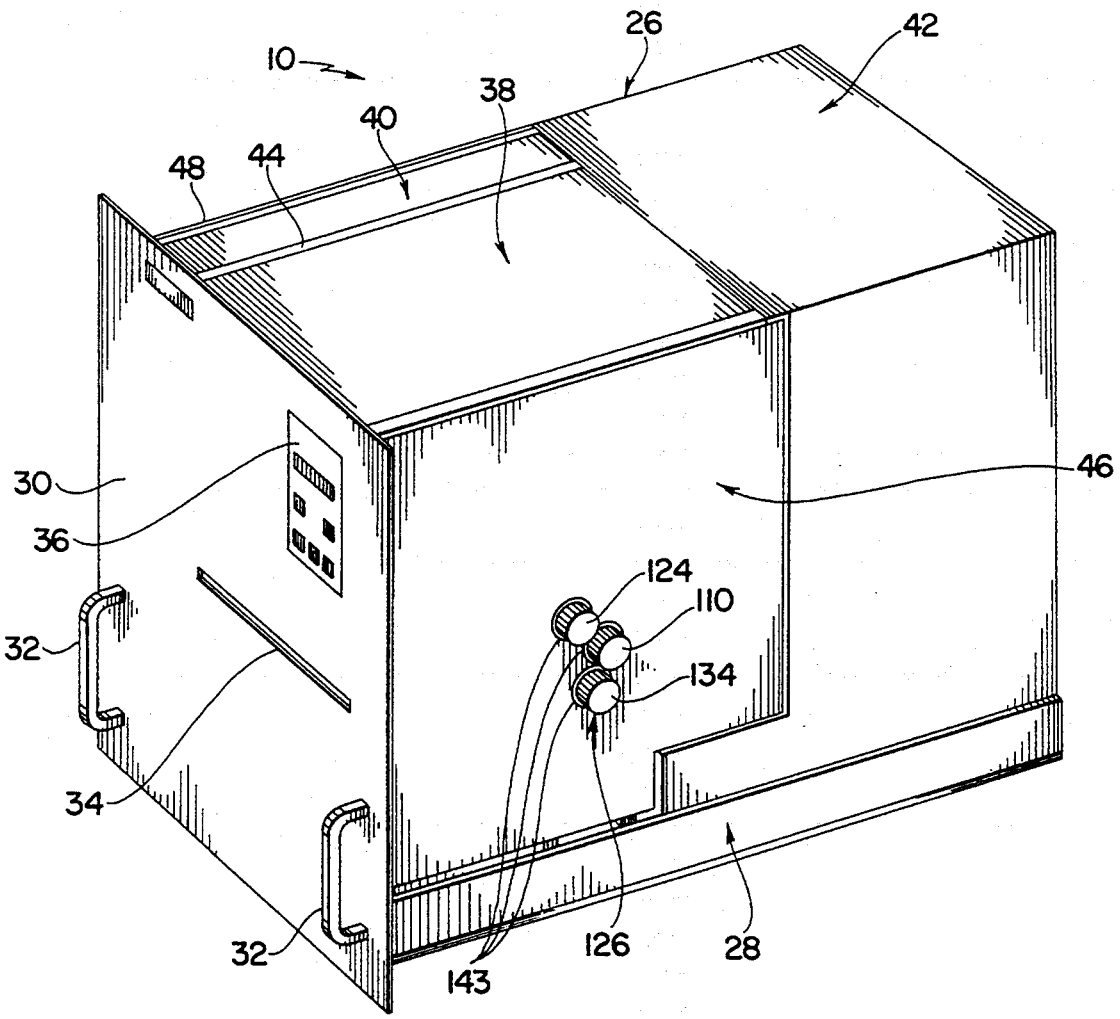
FIG. 1 is a perspective view of the single-pass multi-color thermal printer as embodied in the instant invention.
Figure 2:
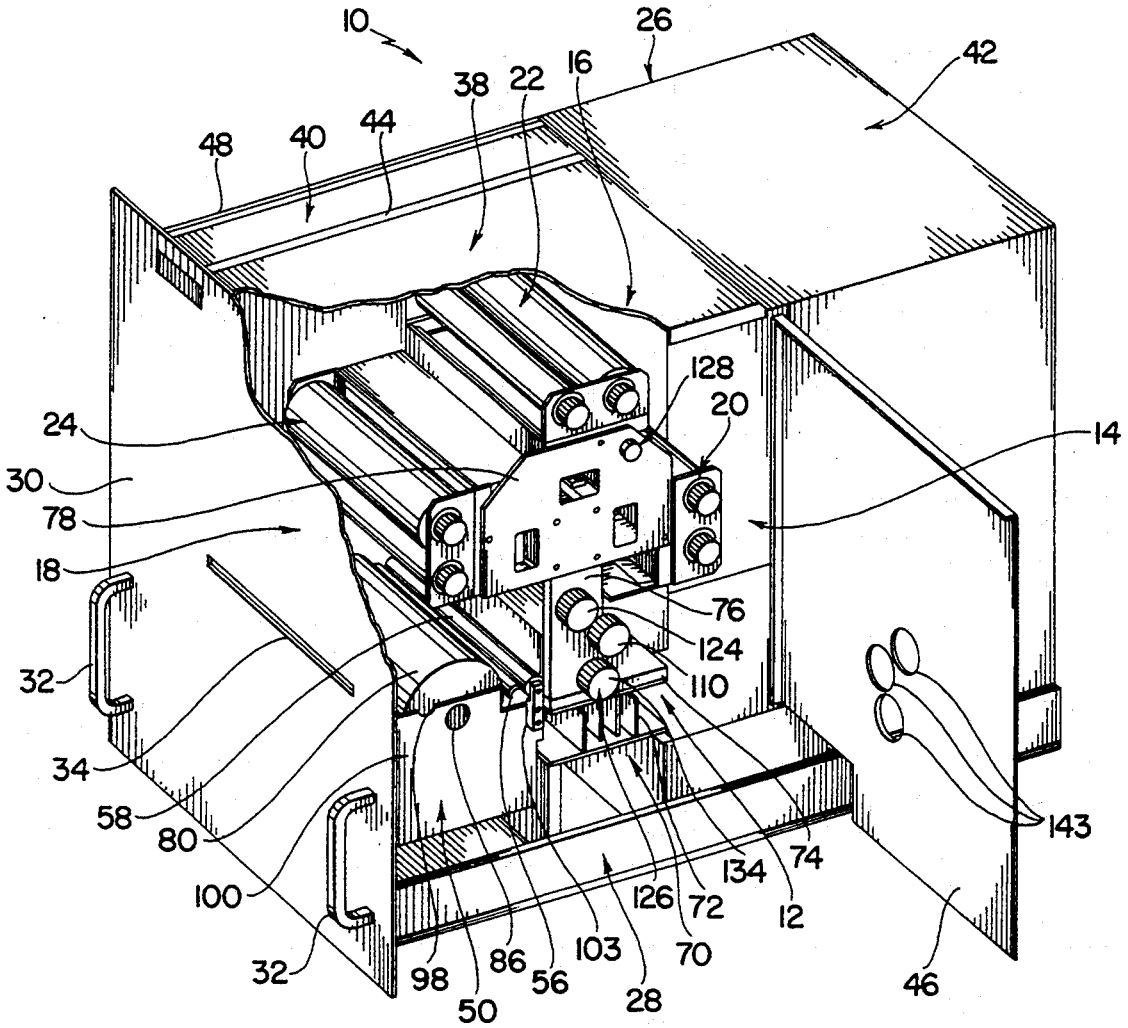
FIG. 2 is another perspective view thereof with the top and front of the enclosure broken away and the side door thereof opened to expose the media transport system and the thermal printhead assemblies.

Referring now to the drawings, the single-pass multi-color thermal print engine of the instant invention is illustrated and generally indicated at 10 in FIGS. 1 through 5. The print engine 10 generally comprises a media transport system generally indicated at 12 and three thermal printhead assemblies generally indicated at 14, 16 and 18. Each of the printhead assemblies, 14, 16 and 18, includes a corresponding ribbon cassette, generally indicated at 20, 22 and 24. The printer 10 is preferably supported in a rack type enclosure generally indicated at 26. The rack type enclosure 26 is preferably mounted in a mounting rack (not shown) on a pair of slide rails 28 so that the enclosure 26 moves on these slides in and out of the mounting rack to accommodate unit servicing and receptor media loading. The enclosure 26 includes a front panel 30 which has a pair of handles 32 for moving the enclosure 26 in and out of the mounting rack, a media output slot 34 through which printed media is received and a control panel 36 for controlling the operation of the printer 10. The enclosure 26 is divided into three compartments: a main compartment 38 which houses the media transport system 12 and the printhead assemblies 14, 16 and 18; a drive compartment 40 adjacent the main compartment 38 which houses three stepping motors for respectively driving the media transport system 12, pivoting the printhead assemblies, 14, 16 and 18, and driving the ribbon cassettes 20, 22, and 24; and a rear electronics compartment 42 which houses the power supplies (not shown) and the control electronics (not shown). The main compartment 38 is separated from the adjacent drive compartment 40 by an interior bulkhead 44. The main compartment 38 further includes a hinged side door 46 which swings open to allow service access to the printhead assemblies 14, 16 and 18 and the media transport system 12. The drive compartment 40 is defined by the interior bulkhead 44 and an exterior bulkhead 48. The electronics compartment 42 is fashioned from sheet metal.

The media transport system 12 comprises a media tray generally indicated at 50, a tensioning arm generally indicated at 52, a media guide 54 having an "S"-shaped guide portion 56, an idler roll 58, a pair of input pinch rollers generally indicated at 60, three centrally located platen rollers 62, 64 and 66 which are equally spaced over an 180 degree arc, and a pair of output drive rollers generally indicated at 68. An elongated rod 69 is positioned between the input pinch rollers 60 and the output drive rollers 68. The rod 69 does not function as part of the media transport system but instead acts as a spacer between the input pinch rollers 60 and the output drive rollers 68. The media transport system is mounted to a slide assembly generally indicated at 70 which enables the media transport system 12 to be slidably movable between a printing position (FIG. 2) wherein the platen rollers 62, 64 and 66 are positioned beneath the printhead assemblies 14, 16 and 18 for printing and a withdrawn position (FIGS. 3 and 4) wherein the platen rollers 62, 64 and 66 are withdrawn from beneath the printhead assemblies 14, 16 and 18 for receptor loading and ribbon cassette replacement. In this regard, the media transport system 12 slides outwardly of the enclosure 26 through the side door 46. The slide assembly 70 comprises a conventional slide rail 72, a base 74, right and left upwardly extending walls, 76 and 77 respectively (FIG. 4), and a cover plate 78 mounted to the right wall 76. The media tray 50 is mounted to the base 74 and the media guide 54, input pinch rollers 60, platen rollers 62, 64 and 66, output drive rollers 68 and elongated rod 69 are mounted between the walls 76 and 77.

The media tray 50, tensioning arm 52 and media guide 54 work together as a media tensioning system to create "media back tension" which helps insure proper media tracking throughout the transport system 12. The media tray 50 is fashioned from sheet metal in a rectangular configuration and it is effective for holding an interrupted length of receptor media 79. In this regard, the media tray 50 is adapted to hold either roll media 80 or fan-fold media 82. The media tray 50 includes a roll arbor 84, a first set of mounting sockets 86 centrally located on the media tray 50, and a second set of mounting sockets 88 located to the rear of the first set of sockets 86. The mounting sockets 86 and 88 are utilized for mounting the arbor 84 and the tensioning arm 52 within the media tray 50. It is pointed out that the mounting positions of the arbor 84 and tensioning arm 52 change with respect to the type of receptor media 79 which is loaded in the media tray 50. When roll media 80 is loaded, the arbor 84 is positioned in the center set of mounting sockets 86 and the tensioning arm 52 is mounted in the rear set of sockets 88 to the rear of the roll media 80. When fan-fold media 82 is loaded, the roll arbor 84 is stored in the rear mounting sockets 88 and the tensioning arm 52 is mounted in the center mounting sockets 86.

The tensioning arm 52 (FIG. 5) comprises a rigid arm 90, a spring 91 and a mohair pad 92 mounted to the bottom of the arm 90 which makes tangential contact with the receptor media 79. When the tensioning arm 52 is mounted in the rear sockets 88 the spring 91 thereof is biased against the rear wall 94 of the media tray 50. Further, when the tensioning arm 52 is mounted in the center sockets 86 the spring 90 is biased against an elongated rod 96 (shown in broken lines) which is received in a pair of slots 98 (also shown in broken lines) formed in the sidewalls 100 of the media tray 50.

Figure 5:
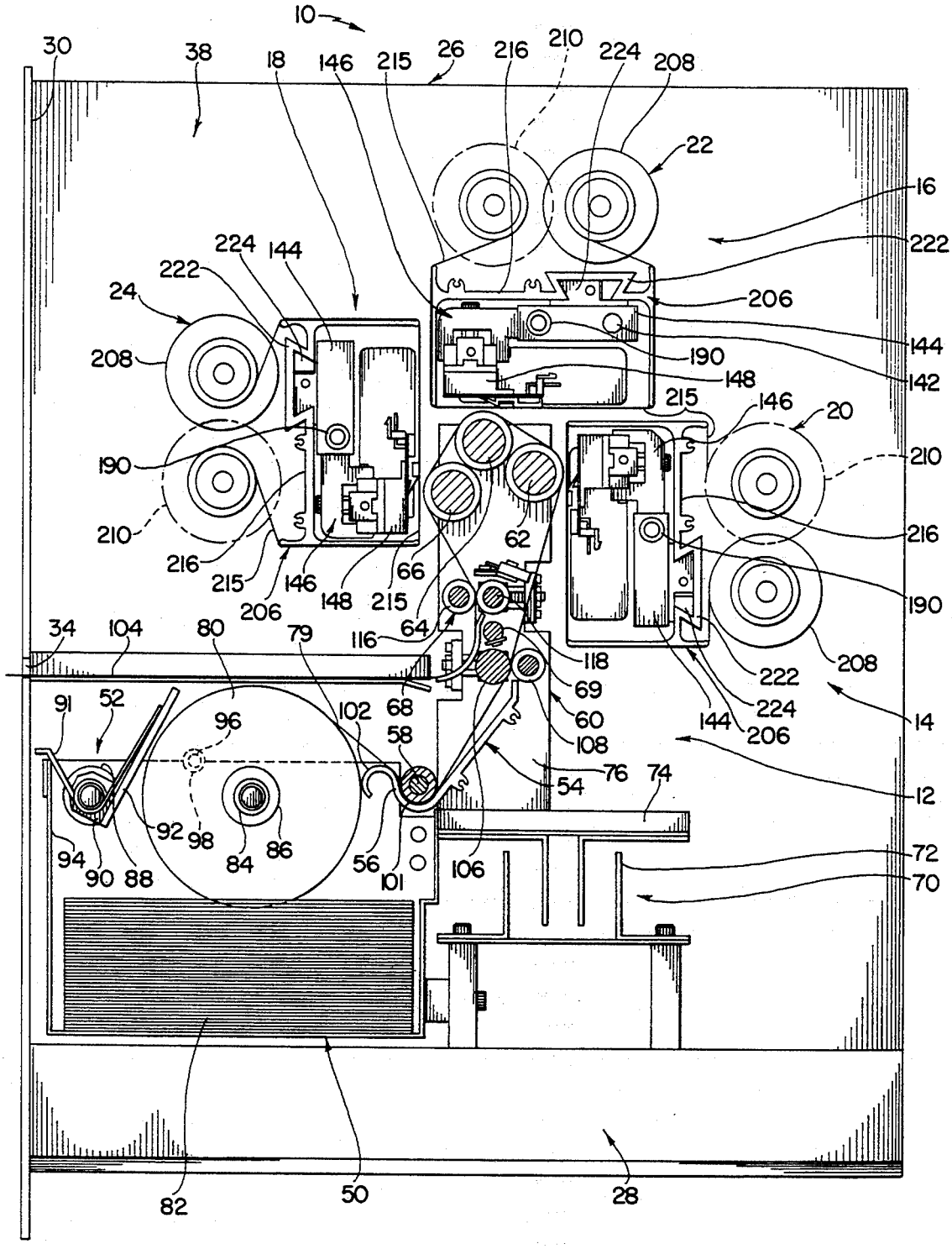
FIG. 5 is a side view thereof with the circular media path shown in bold line.

The media guide 54 comprises an elongated aluminum extrusion and it is mounted between the walls 76 and 77. The "S"-shaped guide portion 56 of the media guide 54 is positioned adjacent to the media tray 50 and it includes a large inside curve 101 and a smaller outside curve 102. The idler roll 58 is mounted between two mounting blocks 103 which are attached to the side walls 100 of the media tray 50. It is pointed out that the positions of the mounting blocks 103 are adjustable to provide tracking adjustments. The idler roll 58 is mounted so that it rests in the inside curve 101 of the "S"-shaped guide portion 56 and forces the receptor media 79 to conform to the shape of the inside curve 101 as it passes therethrough thus creating a significant wrap around the idler roll 58. As seen in FIG. 5, when roll media 80 is loaded in the printer 10 the tensioning arm 52 makes tangential contact directly with the roll 80. It can be appreciated that when fan-fold media 82 is loaded in the printer and the tensioning arm 52 is mounted in the center mounting holes 86, the tensioning arm 52 makes tangential contact with the receptor media at the outside curve 102 of the media guide 54. The tensioning arm 52 thus applies tangential pressure to the receptor media 79 and creates a frictional drag between the media 79 and the media guide 54.

The flow path of the receptor media 79 is clearly illustrated in FIG. 5 wherein the receptor media 79 passes out of the media tray 50 and threads through the media guide 54, through the input pinch rollers 60, around the three platen rollers 62, 64 and 66 and finally through the output drive rollers 68. The media 79 then passes over an elongated support member 104 and outwardly of the enclosure 26 through the output slot 34 in the front panel 30 thereof.

The input pinch rollers 60 comprise a stationary rod 106 which does not rotate and a passive roller 108, i.e. no drive, which rotates in a standard fashion as the receptor media 79 is drawn between the rod 106 and the roller 108. The passive roller 108 includes a knob 110 (FIGS. 1–4) for manually rotating the roller 108 in order to advance the leading edge of the receptor media 79 through the input pinch rollers 60 when loading the receptor media 79 into the printer 10. Mounted to the shaft of the passive roller 108 is a sprocket 112 (FIG. 4). As the passive roller 108 rotates, the teeth of the sprocket 112 pass through a sensor 114 which provides a signal indicating that the roller 108 is rotating. It can therefore be seen that the sensor 114 is operative for detecting when there is no media 79 left in the media tray 50.

The three equally spaced platen rollers 62, 64 and 66 comprise standard one inch platen print rollers. The use of the three equidistant platen rollers mounted around an 180 degree arc provides a compact print station in which all three printhead assemblies can be mounted in close proximity. The equidistant rollers also define a substantially arcuate media path through the printer 10. The arcuate media path, together with the media back tensioning system stiffens the receptor media 79 to insure a stable media path and good media position control within the printer 10. It is pointed out that most single-pass color printers utilize a single large drum platen to accomplish stable media tracking. The use of three equidistant platens provides several advantages over the single drum platen. In thermal color printing, the large radius of the drum platen would require the use of custom designed thermal printheads with larger than standard ceramic substrates, so that there is sufficient space on either side of the dot elements to accommodate the radius of the drum. The use of three standard one inch diameter platens eliminates the high cost of the large platen drum and allows the use of standard thermal printheads. Equidistant mounting of the platen rollers around a 180° arc allows the printhead assemblies to be positioned in close proximity thereby minimizing the distance between the printheads. Still further, the use of three smaller diameter platens instead of one large drum reduces the surface area contact of the receptor media on the platens thereby reducing the degree of wrap encountered with a single drum. The shorter distance between the platen rollers and the reduced degree of wrap minimize stretching and deformation of the media which can cause print registration errors. The compact print station also significantly reduces the size of the printer because the printhead assemblies are no longer spaced over an elongated straight path.

The output drive rollers 68 are located downstream of the platen rollers 62, 64 and 66 and they comprise a drive roller 116 and a passive roller 118. The passive roller 118 rotates with the drive roller 116 to provide the nip required to pull the receptor media 79 through the printer 10. The drive roller 116 is driven by a drive assembly generally indicated at 119 (FIG. 4) which is mounted to the interior bulkhead 44. The drive assembly 119 includes a stepping motor 120, a gear reduction box 120*a* for reducing the rotation of the stepping motor 120 and a drive coupling 121 which extends through the interior bulkhead 44. A corresponding shaft portion 122 of the drive roller 116 engages and disengages with this coupling 121 when the media transport system 12 is slidably moved in and out of the printing position. The drive roller 116 further includes a knob 124 (FIGS. 1–4) for manually rotating the roller 116 in order to advance the leading edge of the receptor media 79 through the output drive rollers 68 when loading receptor media 79 into the printer 10.

It is pointed out that an integer relationship exists between the circumference of the output drive rollers 68 and the distance between each printhead dot line. The integer relationship establishes a periodicity correction method which compensates for radial or circumferential deviations in the output rollers 68. The integer relationship insures one, or more complete revolutions of the output rollers when advancing the media 79 between printhead dot lines and effectively reduces print registration errors due to shaft eccentricities, circumferential imperfections, etc. It is further pointed out that an integer relationship also exists between the circumference of the platen rollers 62, 64, 66 and the distance between each printhead dot line. This integer relationship further insures periodicity corrections for deviations in the surfaces of the platen rollers.

The slide assembly 70 includes two captive screw fasteners, generally indicated at 126 and 128 respectively, for locking the media transport system in the printing position. The screw fasteners 126 and 128 are most clearly illustrated in FIGS. 3 and 4. The first screw fastener 126 is located adjacent the input pinch rollers 60 and it comprises an elongated rod 130 having a threaded portion 132 on one end and a knob 134 mounted on the other end. The rod passes through the upright walls 76 and 77 and it is mounted therein so that it is rotatable. When the media transport system is in the printing position the threaded portion 132 of the rod 130 is received into a corresponding threaded aperture 136 located in the interior bulkhead 44. The second screw fastener 128 is mounted on the cover plate 78 of the slide assembly 70 and it includes a threaded bolt 138 and a knob 140 attached to the head thereof for manually rotating the threaded bolt 138. Similar to the first fastener 126, when the media transport assembly is in the printing position the threaded bolt 138 is received into a threaded aperture 142 located in the cantilever arm of the center thermal printhead assembly 16. The screw fasteners 126 and 128 ensure that the platen rollers 62, 64 and 66 are maintained in a stable position during operation of the printer 10. To withdraw the media transport assembly 12 for receptor media loading, the captive screw fasteners 126 and 128 are unfastened and the transport assembly 12 is then slidably withdrawn from beneath the printhead assemblies by means of the slide rail 72.

It is pointed out that the knobs 110, 124, and 134 for the input pinch rollers 60, the output drive rollers 68 and the first captive screw fastener 126 project through apertures 143 in the side door 46 of the enclosure 26 when the side door 46 is closed. (See FIGS. 1 and 2).

Figure 7:
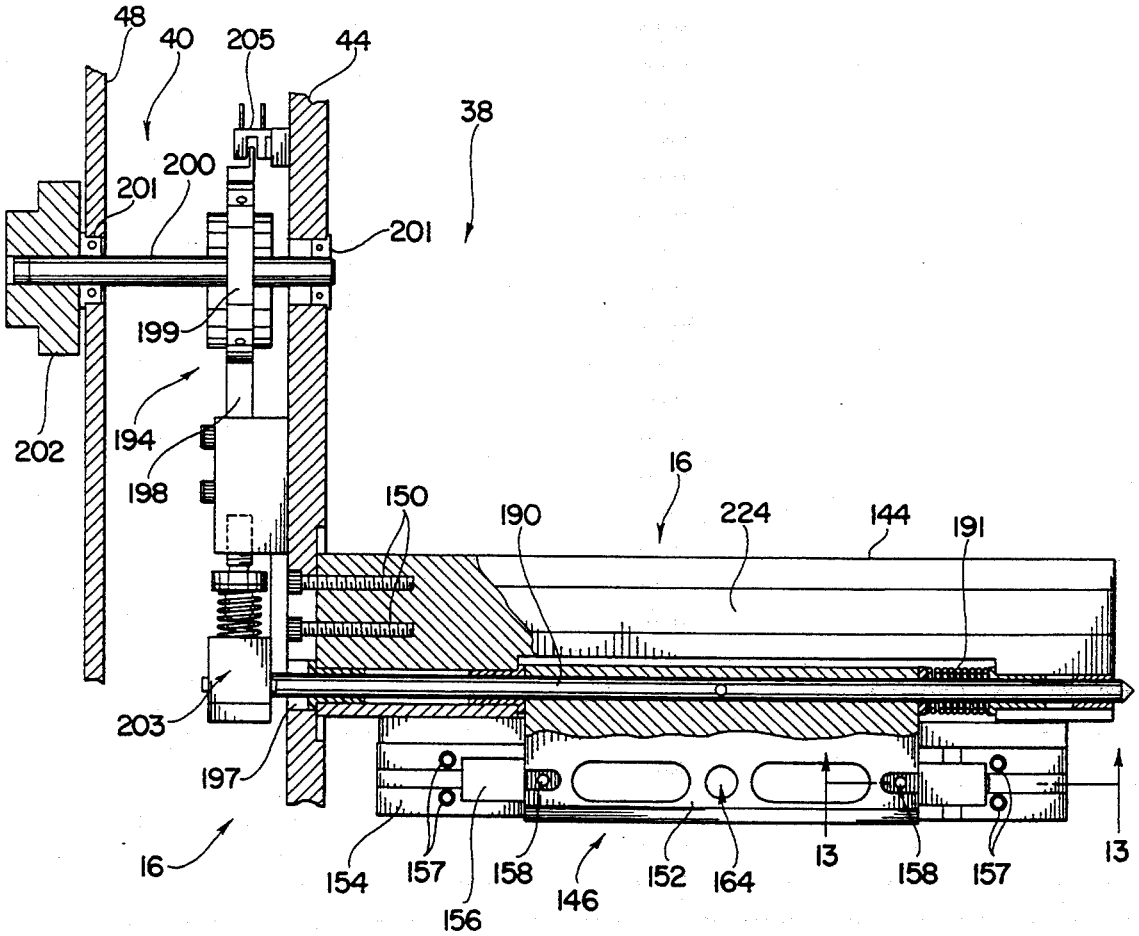
FIG. 7 is a top view of the printer, partially in section, with the one of the printhead mounting assemblies and its associated printhead pivot assembly shown in detail.

The thermal printhead assemblies 14, 16 and 18 are identical in construction except with regard to their mounting orientation. Referring now to FIGS. 5 and 7, each of the thermal printhead assemblies 14, 16 and 18 comprises a cantilever beam 144, a mounting assembly generally indicated at 146, and a thermal printhead 148 having a thermal print dot line. Each of the printhead assemblies 14, 16 and 18 corresponds to a respective roller platen 62, 64 and 66 wherein the printheads 148 thereof make tangential contact with the receptor media 79 passing therearound. The cantilever beams 144 are fastened to the interior bulkhead 44 by a pair of bolts 150 which pass through the interior bulkhead 44. Referring now to FIGS. 7, 11, 12 and 13, the mounting assemblies 146 each comprise a support arm 152, a mounting head 154 and a mounting bar 156. The mounting head 154 is secured to the printhead 148 by bolts 157. The mounting bar 156 is connected to the mounting head 154 by a pair of vertical bolts 158 which pass through vertical slots 160 in the mounting bar 156 and into corresponding threaded holes 162 in the mounting head 154. The support arm 152 is connected to the mounting bar 156 through a spherical bearing assembly generally indicated at 164 (see FIG. 12) which is mounted in the center of the arm support 152. The spherical bearing 164 includes a threaded bolt 165 which is received in the mounting bar 156 and allows the printhead 148 to spherically rotate about the center of the mounting assembly 146. The support arm 152 further includes a pair of horizontal adjustment screws 166 and a pair ball plungers 168. The screws 166 and plungers 168 are mounted opposite one another at each end of the support arm 152. The adjustment screws 166 and ball plungers 168 operate to restrict the rotational movement of the printhead 148 through the center of the spherical bearing. 164. By rotating either adjustment screw 166, small adjustments to the angular orientation of the dot line can be accomplished. The ball plunger 168 ensures that there is no play in the movement thereof. The adjustment screws 166 and the ball plungers 168 thereby allow both angular and front-to-back adjustments of the dot line while still allowing the printhead 148 to spherically pivot with respect to its respective platen roller when engaged therewith. The mounting assembly 146 further includes a side-to-side adjustment mechanism generally indicated at 170 for shifting the printhead 148 along the axis of the dot line. This adjustment mechanism 170 allows adjustment of the dot line alignment from one printhead to another printhead. The adjustment mechanism comprises an upright block 172 which is fastened to the mounting head 154 in any suitable manner, an adjustment screw generally indicated at 174 which passes through the end of the mounting bar 156 and the upright block 172, and a spring 176 to bias the adjustment screw 174. The adjustment screw 174 includes a head portion 178 which extends outwardly of the mounting bar 156, a threaded portion 180 which passes through mating threads 182 in the upright block 172 and a post portion 184 which is received in a bore 186 inside the bar portion 172. The screw 174 is captivated in the assembly by a pin and groove arrangement generally indicated at 188. The pin and groove arrangement 188 allows the screw 174 to rotate but prevents it from escaping. Shifting a printhead 148 along its dot line is accomplished by loosening the bolts 158 which hold the mounting bar 156 to the mounting head 154 and rotating the adjustment screw 174. The mating threads of the screw 174 and block 172 force the printhead 148 to the right or to the left according to the direction of rotation of the screw 174. The bolts 158 are then retightened to hold the printhead 148 in the adjusted position. Since the bolts 158 pass through slots 160 in the mounting bar 156, the printhead is able to shift to the left or right. Thus, it can be seen that the mounting assemblies 146 allow the printheads 148 to be adjusted angularly about the center of their dot line, as well as permitting front-to-back and side-to-side dot line movement. The mounting assemblies 146 also allow the printheads 148 to spherically pivot thereby equalizing the tangential pressure along their dot lines when the printheads 148 are biased against their respective platen rollers.

Referring specifically now to FIG. 7, the support arm 152 of the mounting assembly 146 is mounted to the cantilever beam 144 by means of a pivot shaft 190 which passes through the cantilever beam 144 and the support arm 152. The mounting assembly 146 is held in biased position by a spring 191 mounted on the shaft 190 between the cantilever beam 144 and the mounting assembly 146. The shaft 190 is keyed to the support arm 152 so that the mounting assembly 146 is pivotable towards and away from its respective roller platen when the pivot shaft 190 is rotated. In this regard, all of the printhead assemblies 14, 16 and 18 are pivotable between an "up" position wherein the printheads 148 are disengaged from the platen rollers 62, 64 and 66 (See FIGS. 8 and 10) and a "down" position wherein the printheads 148 are in biased engagement with the platen rollers (See FIG. 9).

Figure 8:
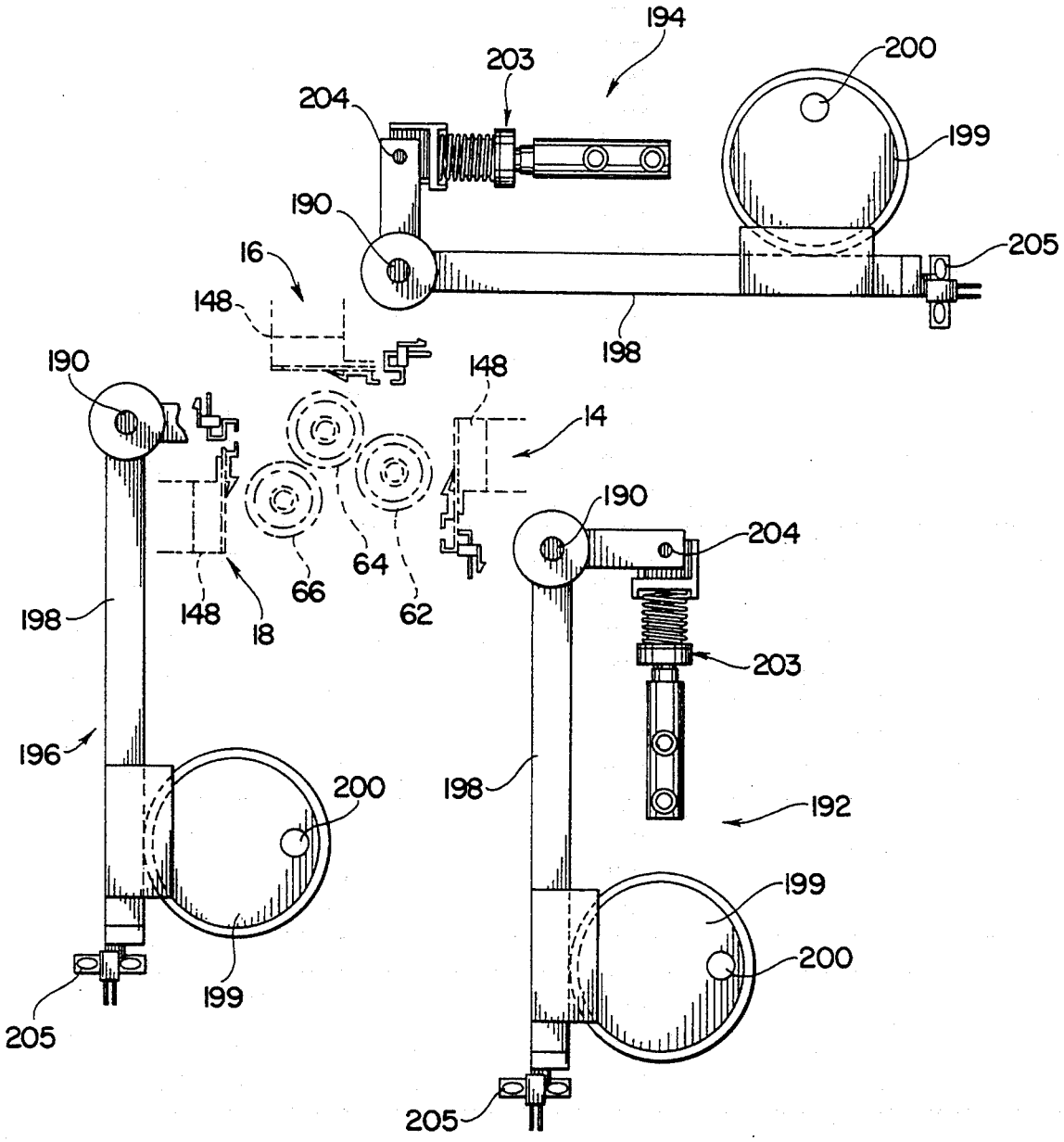
FIG. 8 is a side view of the three printhead pivot assemblies shown in spaced relation.
Figure 9:
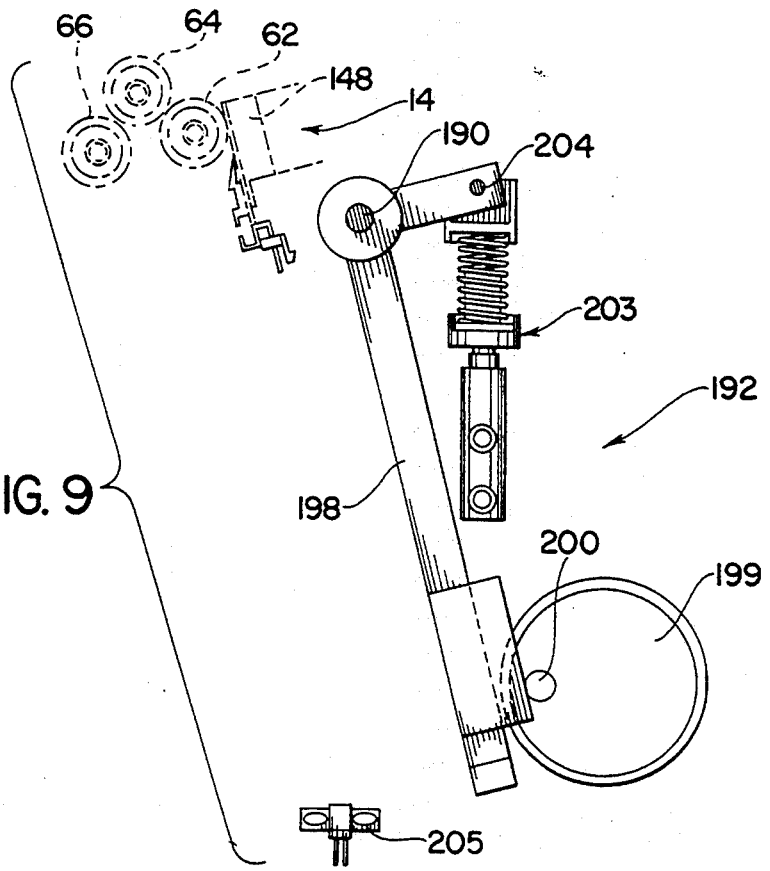
FIG. 9 is an enlarged view of one of the printhead pivot assemblies with the printhead in the "down" position.
Figure 10:
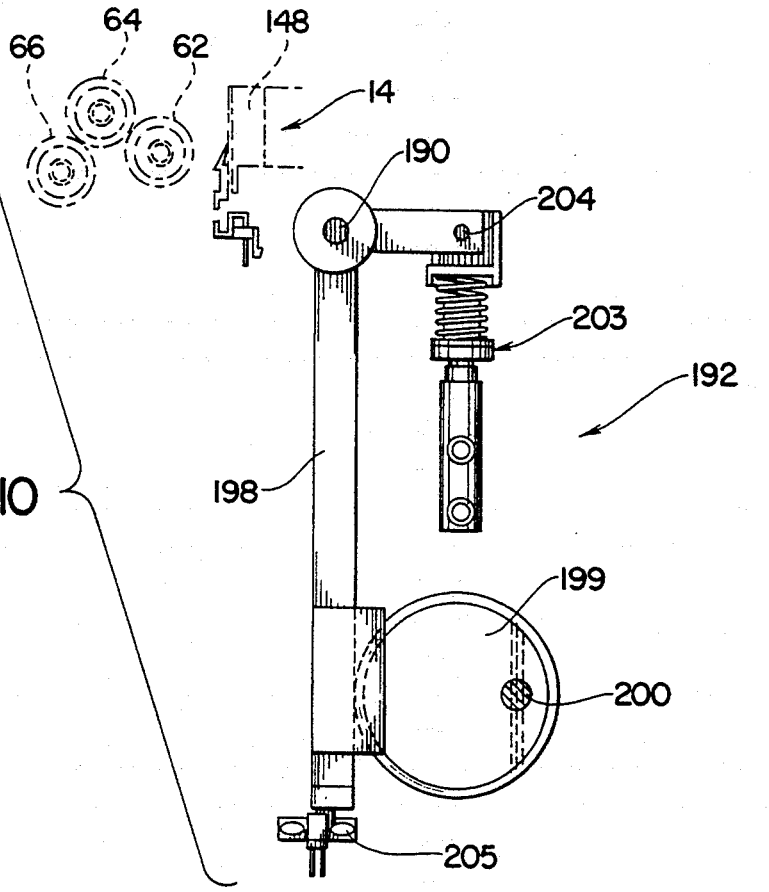
FIG. 10 is a similar view thereof with the printhead in the "up" position.
Figure 11:
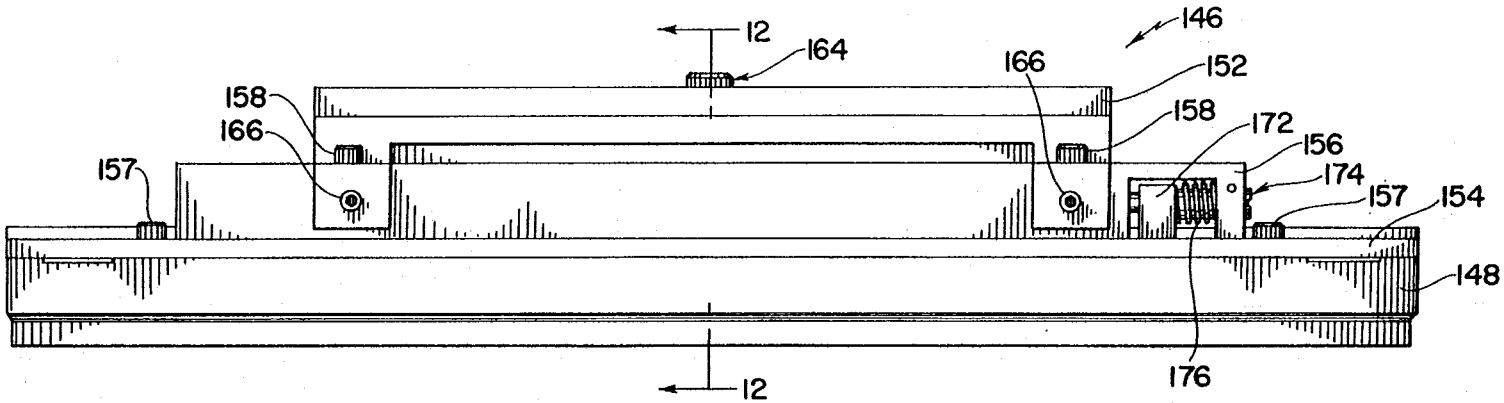
FIG. 11 is a front view of one of the printhead mounting assemblies.
Figure 12:
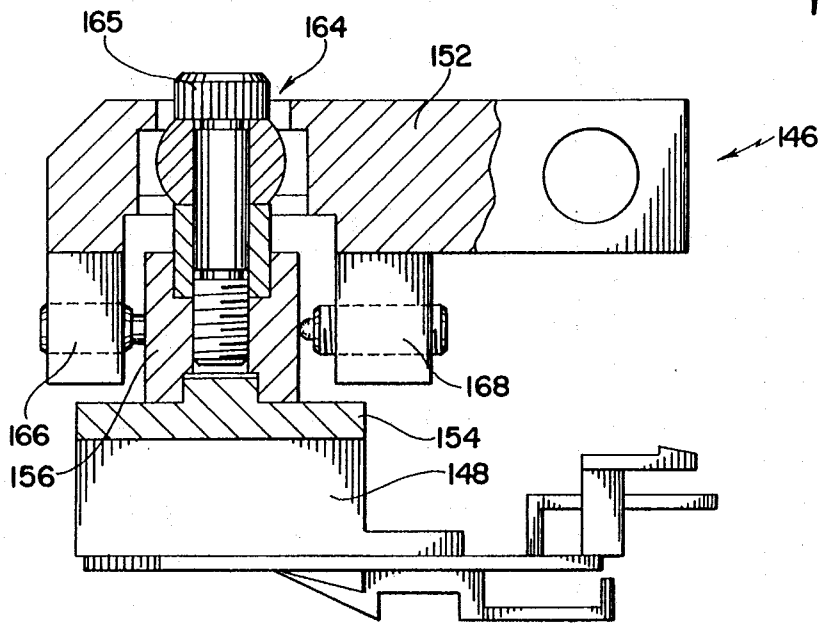
FIG. 12 is a cross sectional view taken along line 12—12 of FIG. 11.
Figure 13:
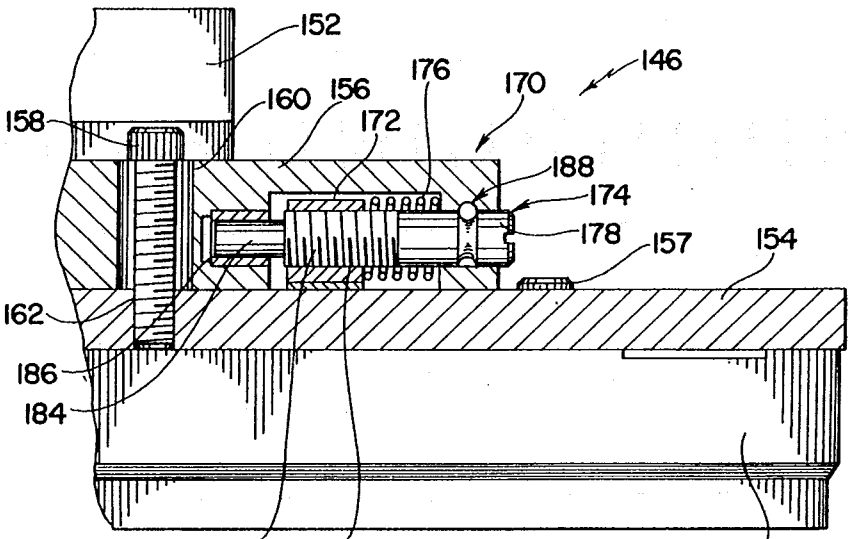
FIG. 13 is an enlarged cross sectional view taken along line 13—13 of FIG. 7.

Movement of the printheads 148 between the "up" position and the "down" position is accomplished through individual printhead pivot assemblies 192, 194 and 196 which are located in the drive compartment 40 and mounted to the interior bulkhead 44. Each pivot assembly 192, 194 and 196 corresponds to a respective printhead assembly 14, 16 and 18. The mounting shaft 190 of each mounting assembly passes through a rotatable coupling 197 in the interior bulkhead 44 and is connected to its own pivot assembly. Referring now to FIG. 8, each pivot assembly comprises a lever 198 and cam 199 arrangement. The levers 198 are keyed to the pivot shafts 190 and pivot therewith to raise and lower the mounting assemblies 146, Each of the cams 199 is keyed to a shaft 200 which passes through rotatable couplings 201 mounted in the interior and exterior bulkhead 44 and 48 respectively. The shafts 200 are in turn keyed to pulleys 202 (FIG. 7). A drive belt (not shown) passes around all three pulleys 202 and also passes around the drive shaft of one of the stepping motors (not shown). All three of the pulleys 202 are therefore driven by a common motor so that all three cams 199 are rotated simultaneously. Each pivot assembly includes a spring assembly generally indicated at 203 which is pivotally connected to the lever 198 by a pin 204. The spring assemblies 203 maintain the levers 198 in biased contact with the cams 199 which hold the levers 198 and associated printheads 148 in the "up" position (FIGS. 8 and 10). When the cams 199 are rotated, the springs assemblies 203 ensure rotational movement of the pivot shafts 190, thus lowering the mounting assemblies 146. The printheads 148 then make contact with their respective platen 62 and stop (See FIG. 9). The cams 199 however continue to rotate, leaving the surface of levers (FIG. 9). In this regard, the spring assemblies 203 ensure positive pressure between the printheads 148 and the platen rollers 62. It is contemplated that in alternative embodiments the printhead pivot assemblies could be individually actuated so that individual printheads could be raised or lowered individually. This type of arrangement would enable the printer to print in single colors if desired. It is pointed out that individual printhead lifts could also be utilized for saving ribbon during printing. During printing in a continuous feed printer, the printheads, and hence the ribbon, are continuously in contact with the receptor media. Since the printheads are spaced apart, it can be appreciated that once printing is completed at an upstream printhead the ribbon continues to rotate until printing is completed at the furthest downstream printhead. The print lag on the receptor media thus wastes a significant portion of the ribbon roll during the lag period. Individual printhead pivot assemblies could be utilized for lifting the individual printheads after printing is completed at the upstream printhead thus preventing the ribbon from continuous rotation during printing at all the downstream print stations.

Each pivot assembly 192, 194 and 196 further includes a sensor 205 for sensing when the printheads 148 are in the "up" or "down" position. As illustrated in FIGS. 9 and 10, when the printheads 148 are in the "up" position (FIG. 10) the ends of the levers 198 are engaged with sensors 205 and when the printheads are in the "down" position (FIG. 9) the ends of the levers are disengaged from the sensors 205. The sensors 205 thereby provide an electronic signal which is used to selectively indicate movement of the printheads from the "up" to the "down" position, or vice versa. Such an indication is preferably shown on a liquid crystal display portion of the control panel 36.

Figure 3:
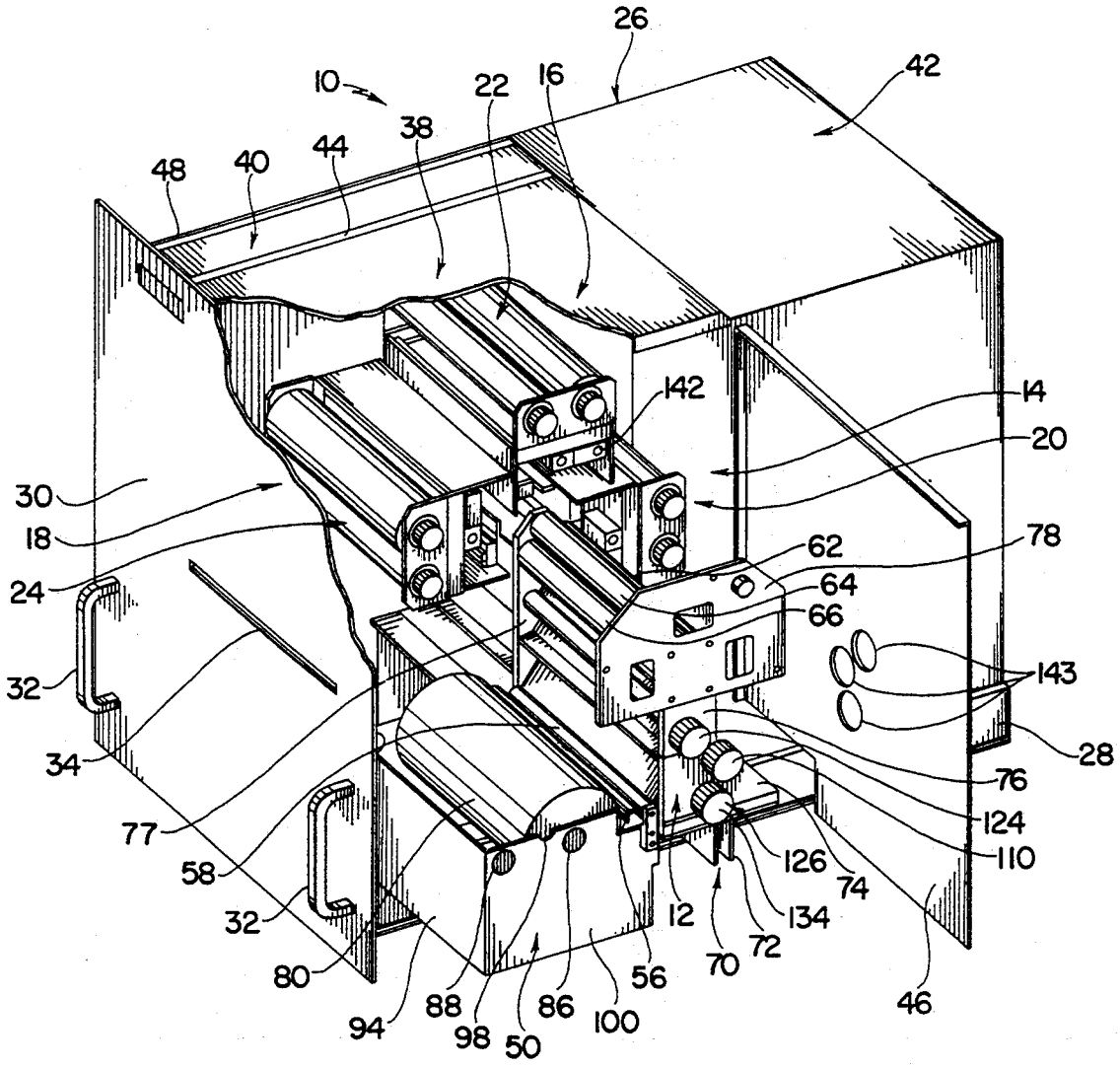
FIG. 3 is a similar view thereof with the media transport system extended outwardly of the enclosure.
Figure 4:
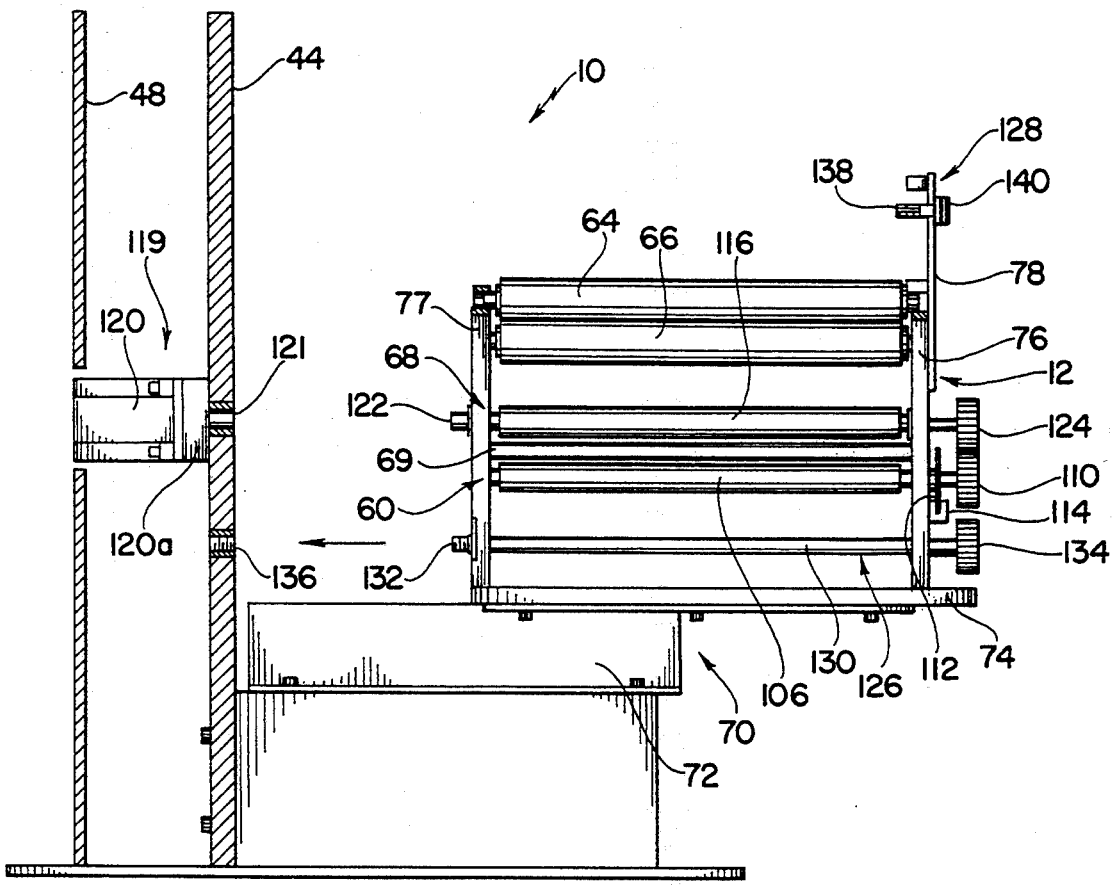
FIG. 4 is a front view thereof with the media transport system extended outwardly of the enclosure to expose the captive screw fasteners thereof.
Figure 6:
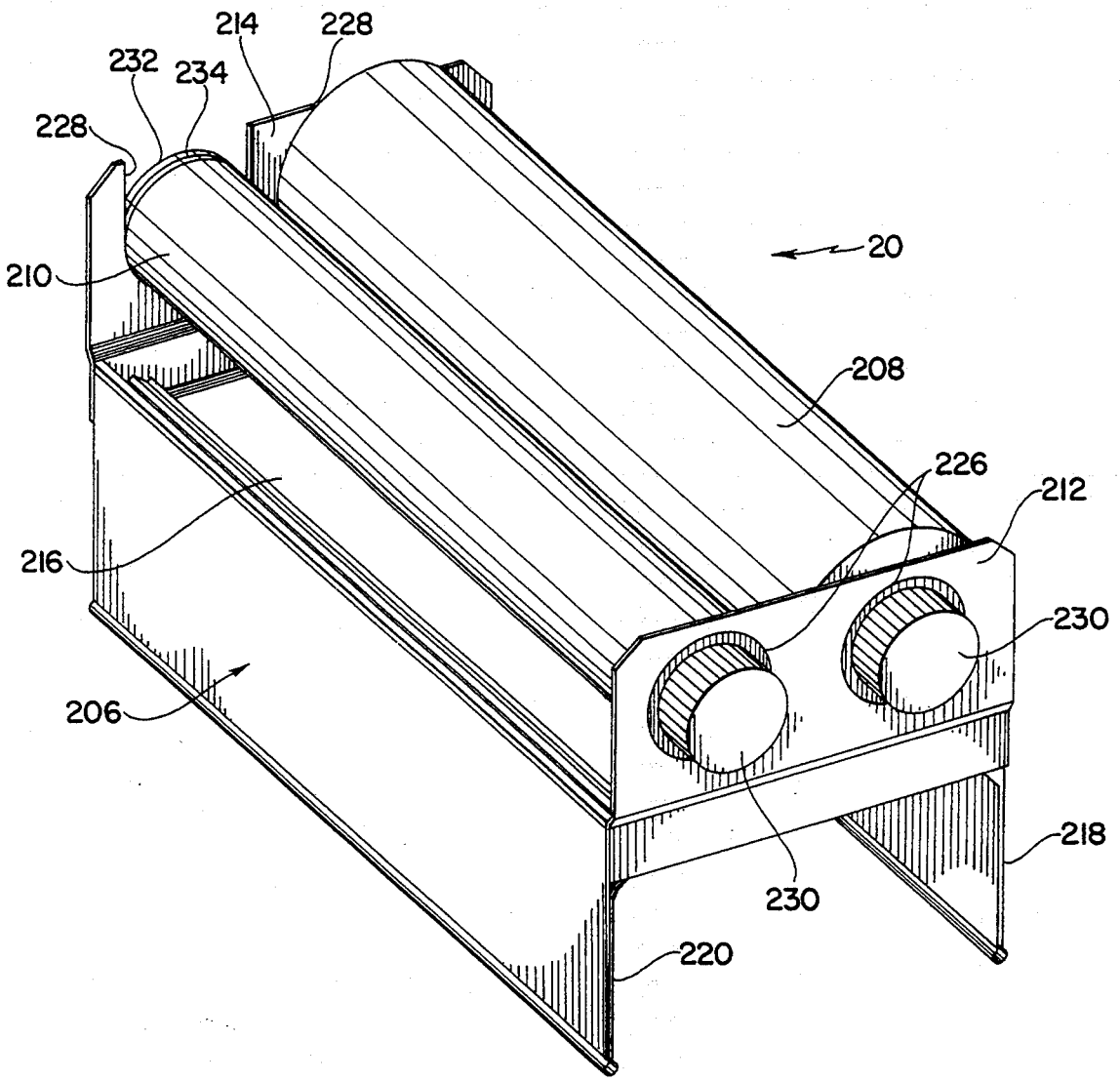
FIG. 6 is a perspective view of one of the re-loadable ribbon cassettes.

The ribbon cassettes 20, 22 and 24 are most clearly illustrated in FIGS. 3, 5 and 6. In FIG. 6 it can be seen that each of the ribbon cassettes comprise a cassette body generally indicated at 206, a ribbon supply roll 208, a ribbon take-up roll 210 and front and rear mounting plates 212 and 214 respectively, for mounting the supply roll 208 and take-up roll 210 to the body 206. The color transfer ribbons 215 are conventional thermal color printing ribbons which are commercially available. The ribbon cassettes 20, 22 and 24 are loaded with one of the three primary printing colors which are used in conventional subtractive color printing. In this regard, it is pointed out that the cassettes are reloadable when the ribbon is exhausted. The first printhead assembly 14 is loaded with a yellow ribbon, the second printhead assembly 16 is loaded with a magenta color ribbon and the third printhead assembly 18 is loaded with a cyan color ribbon. The cassette body 206 comprises an aluminum extrusion which has a horizontal portion 216 and right and left downwardly extending side portions, 218 and 220 respectively. Thee horizontal portion 216 thereof includes a female dovetail slide 222 which is most clearly illustrated in FIG. 5. Each of the cantilever beams 144 includes a corresponding male dovetail slide 224 which is dimensioned to receive the female dovetail slide 222 in sliding engagement. The front and rear mounting plates 212 and 214 are secured to the front and rear portions of the cassette body 206 by any suitable means. It is pointed out that the front mounting plate 212 obscures the view of the dovetail slide 222 in FIG. 6. The front mounting plate 212 includes apertures 226 and the rear mounting plate 214 includes slots 228 for mounting the supply and take-up rolls onto the cassette bodies 206. In this connection, knob plugs 230 are inserted into the front end of the supply roll 208 and take-up roll 210 and drive plugs 232 are inserted into the rear ends thereof. The knob plugs 230 are extended through the apertures 226 in the front plate 212 and grooves 234 in the drive plugs 232 are received in the slots 228 in the back plate 214. To load a new ribbon, the leading edge of the ribbon 215 is drawn over the right and left side portions 218 and 220 of the cassette body 206 and then secured to the empty take-up roll 210. The path of the ribbon 215 around the cassette body 206 is most clearly illustrated in FIG. 5, wherein the cassettes are loaded in the printer and the ribbons 215 pass around the printheads 148. It is contemplated that the ribbon cassettes may be constructed so that they are disposable. Such construction would enable quick and easy replacement without having to reload the individual cassettes when the ribbons are exhausted.

Figure 14:
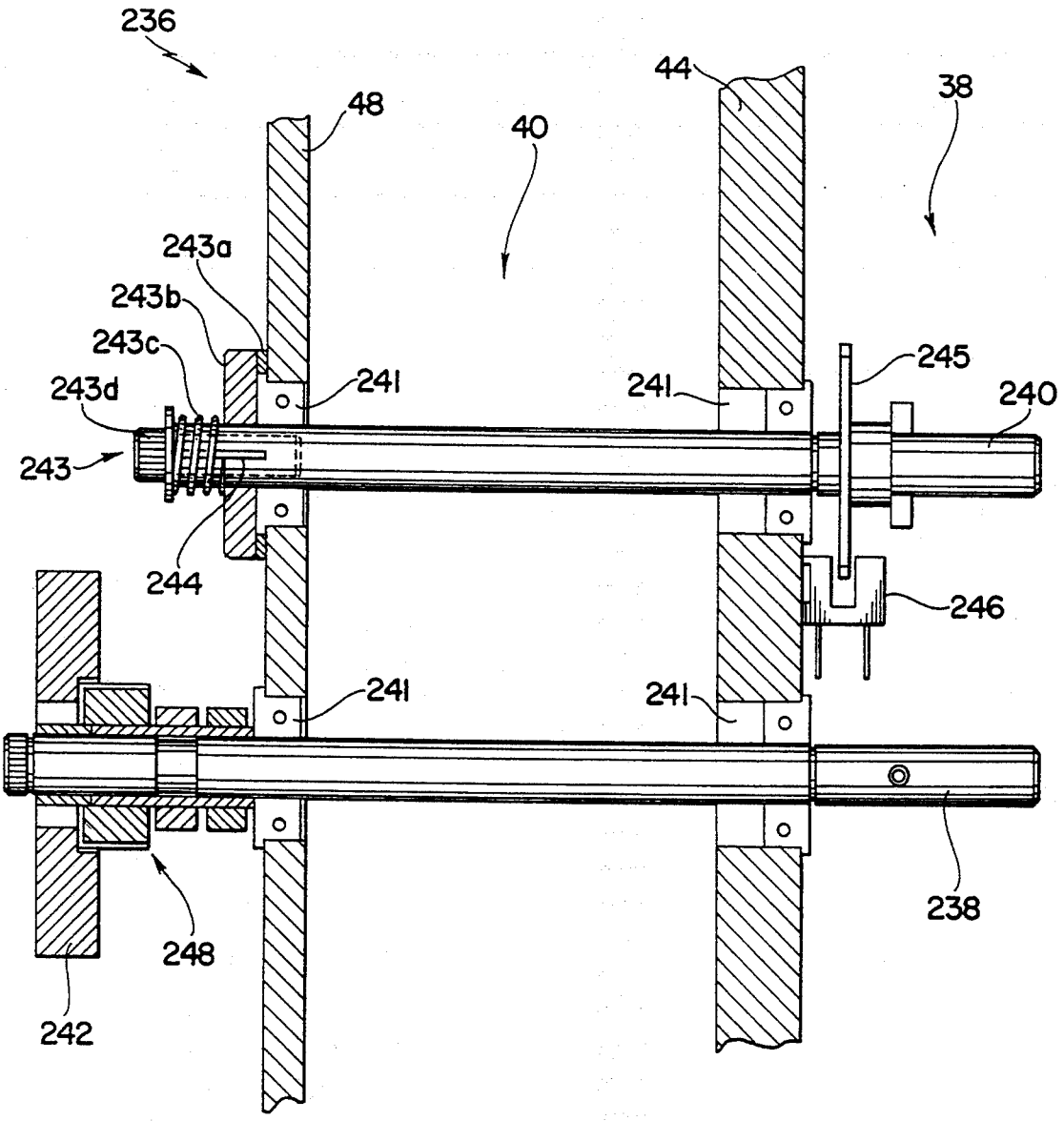
FIG. 14 is a top view of one of the ribbon drive sub-assemblies.

Referring now to FIG. 14, the supply and take-up rolls 208 and 210 of each ribbon cassette are coupled to individual ribbon drive sub-assemblies 236 which are mounted between the interior bulkhead 44 and the exterior bulkhead 48. The ribbon drive assemblies each include a ribbon take-up shaft 238 and a ribbon pay-out shaft 240 which extend through rotatable couplings 241 the interior bulkhead 44 and exterior bulkhead 48. The drive plugs 232 of the ribbon rolls engage and disengage with the pay-out shaft 240 and the take-up shaft 238 when the ribbon cassettes are mounted on and removed from the cantilever beams 144. Each of the take-up shafts 238 includes a pulley 242 which is keyed to one end thereof. A drive belt (not shown) passes around all three pulleys 242 and around the drive shaft of the third of the stepping motors (not shown) so that all three take-up shafts are rotated simultaneously. It is pointed out that the ribbons are not advanced by the take-up shaft 238, but instead are advanced via the printing process. In this connection, the pay-out shaft 240 includes a frictional slip clutch 243 which ensures ribbon back tension thus keeping the ribbon 215 free of wrinkles. The pay-out slip clutch 243 comprises a cork washer **243*a*, a metal washer 243*b*, a coil spring 243*c* and a threaded fastener 243*d* which captures and compresses the spring 243*c* between the fastener 243*d* and the metal washer 243*b*. The metal washer 243*b* is keyed to a slot 244 in the payout shaft 240 so that it rotates with the shaft 240. The compressed spring 243*c* exerts force against the metal washer 243*b* and the pressure of the metal washer 243*b* against the cork washer 243*a* creates friction when the metal washer 243*b* rotates with the pay-out shaft 240. Tension in the clutch 243 is adjusted by rotating the fastener 243*d* whereby the spring is compressed or relaxed for increased or decreased pressure. A plastic sprocket 245 is also keyed to the pay-off shaft 240. The teeth of the sprocket 245 pass through a sensor 246 which provides an electronic signal when the pay-out shaft 240 is rotating. This signal is used to control the speed of the ribbon take-up motor, which is varied with ribbon depletion from the supply roll 208. The sensor 246 is thus effective for ensuring that the take-up motor never pulls the ribbon 215 from beneath the printhead 148. Each of the take-up shafts 238 also includes a conventional frictional slip clutch 248**.

The control electronics (not shown), which control the flow of data to the printheads 148, comprise a controller board, a power card, a front panel display board, and two power supplies. The controller board receives raster data through a dedicated interface port on the communications card from a host system. The controller board includes a plurality of gate arrays which buffer the raster data and transfer it out to the three thermal printheads cards with appropriate delays to synchronize printing of the data between the three thermal printheads. The controller board handles timing and control of the printheads to obtain the printing on the receptor media. The controller board and gate arrays also control the duty cycle of the printhead dots. The power card contains a microstep drive for the stepping motor used to advance the receptor media, as well as the stepping motors used to drive the ribbon cassettes and the printhead pivot assemblies. The power supplies comprise a +5 Volt power supply and a +24 Volt power supply.

It is seen therefore that the instant invention provides an effective single-pass multi-color thermal print engine. The media transport system is mounted to a slide assembly which allows the media transport system to be slidably movable in and out of the printer enclosure for easy receptor loading and ribbon replacement. The platen rollers and printheads are mounted an equal distance around an 180 degree arc, to provide a circular media path which ensures proper media tracking. The circular arrangement of the printheads and platens also significantly reduces the size of the print engine. A media tensioning system provides media back tension further ensuring proper media tracking. The re-loadable ribbon cassettes provide for easy ribbon loading and replacement. The printhead mounting assemblies allow the printheads to be adjusted angularly about the center of their dot line as well as permitting front-to-back and side-to-side dot line movement. For these reasons the single-pass thermal color print engine of the instant invention is believed to represent significant advancement in the printing art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A single-pass multi-color print engine comprising:

a plurality of platen rollers including a first and last platen roller;

means for mounting said platen roller around an arc;

an uninterrupted length of receptor media received around said platen rollers, said platen rollers defining a substantially arcuate path for said receptor media;

a plurality of printheads each corresponding to a respective one of said platen rollers;

means for mounting each of said printheads in corresponding relation to said platen rollers so that each of said printheads makes biased tangential contact with said receptor media at the respective one of said platen rollers; and a pair of driven nip rollers located downstream of said last platen roller for drawing said length of receptor media around said platen rollers from one of said printheads to a subsequent one of said printheads.

2. In the print engine of claim 1, said plurality of platen rollers comprising three platen rollers which are equally spaced around a 180° arc.

3. A single-pass multi-color print engine comprising:

a plurality of platen rollers;

means for mounting said platen roller around an arc;

an uninterrupted length of receptor media received around said platen rollers, said platen rollers defining a substantially arcuate path for said receptor media;

a plurality of printheads each corresponding to a respective one of said platen rollers;

means for mounting each of said printheads in corresponding relation to said platen rollers so that each of said printheads makes biased tangential contact with said receptor media at the respective one of said platen rollers, said means for mounting each of said printheads comprising frame means mounted adjacent to the respective one of said platen rollers and a mounting assembly including a cantilever beam mounted to said frame means adjacent to said respective platen roller; a mounting head attached to a printhead; a mounting bar attached to said mounting head; a support arm; a pivot shaft pivotably interconnecting said support arm with said mounting bar; and spring means for biasing said printhead into tangential contact with said respective one of said platen rollers, said print engine further comprising means for drawing said length of receptor media around said platen rollers from one of said printheads to a subsequent one of said printheads.

4. In the print engine of claim 3, said means for interconnecting comprising:

spherical bearing means which allow said printhead to spherically pivot with respect to said support arm thereby equalizing tangential pressure when said printhead is biased against said respective one of said platen rollers, said printhead comprising a print line having predetermined rotational and front-to-back alignments with respect to said support arm; and means for adjusting the rotational and front-to-back alignment of said printhead print line with respect to said support arm.

5. In the print engine of claim 4, said support arm having first and second end portions, said means for adjusting the rotational and front-to-back alignment of said print line comprising a pair of adjustment screws and a corresponding pair of ball plungers mounted in opposing relation at each end of said support arm.

6. In the print engine of claim 4, said printhead print line having a side-to-side registration with respect to said support arm, said means for mounting said printhead further comprising means for adjusting said side-to-side registration.

7. In the print engine of claim 6, said mounting bar including a pair of elongated slots, said mounting head including a pair of threaded holes, said mounting bar being attached to said mounting head by a pair of threaded bolts which extend through said elongated slots and are received in said threaded holes, said mounting head having first and second ends, said mounting bar having first and second ends and further having a slot formed therein adjacent said first end, said means for adjusting the side-to-side registration of said print line comprising:

an upright block attached to said mounting head adjacent the first end thereof, said block being positioned in said slot, said first end of said mounting bar having a bore extending therethrough, said upright block having a threaded bore extending therethrough; and a threaded adjustment screw which extends through said bore in the first end of said mounting bar and is received in threaded engagement in the threaded bore in said upright block.

8. In the print engine of claim 3, each of said printhead mounting assemblies further comprising means for moving said printheads between a first position wherein said printhead is disengaged from said respective platen roller and a second position wherein said printhead is engages in biased tangential contact with said platen roller.

9. In the print engine of claim 8, said support arm being keyed to said pivot shaft, said means for moving said printheads comprising:

rotatable cam means;

a lever having first and second ends, said first end being keyed to one end of said pivot shaft, said second end providing a bearing surface for said cam means; and spring means biasing said lever against said cam means wherein rotation of said cam means causes rotation of said pivot shaft and movement of said printhead, said spring means further biasing said printhead against said respective platen when said printhead is in said second position.

10. A single-pass multi-color print engine comprising:

at least two platen rollers;

means for mounting said platen rollers in spaced relation;

an uninterrupted length of receptor media received over said platen rollers;

at least two printheads each corresponding to a respective one of said platen rollers, each of said printheads having a print line;

means for mounting said printheads in corresponding relation to said platen rollers so that said each of said printheads makes tangential contact with said receptor media at the respective one of said platen rollers along said print line, said printheads being mounted so that said print line are spaced by a predetermined distance; and a pair of output drive rollers for drawing said receptor media over said platen rollers from one print line to a subsequent print line, said output drive rollers having a predetermined circumference, said predetermined circumference of said output drive rollers and said predetermined distance of said print lines having an integer relationship so that each of said output drive rollers rotates at least one complete revolution when advancing said media between said print lines.

11. In the print engine of claim 10, said platen rollers having a predetermined circumference, said predetermined circumference of said output drive rollers, said predetermined circumference of said platen rollers and predetermined distance of said print lines having an integer relationship so that each of said platen rollers and each of said drive rollers rotates at least one complete revolution when advancing said media between said print lines.

* * * * *